US006658807B2

(12) United States Patent
Gambale

(10) Patent No.: US 6,658,807 B2
(45) Date of Patent: Dec. 9, 2003

(54) DOUBLE CURVED TILE AND METHOD AND SYSTEM FOR COVERING A ROOF THEREWITH

(75) Inventor: Stefano Gambale, Mirabello (IT)

(73) Assignee: Gambale Srl, Mirabello (IT)

( * ) Notice: Subject to any disclaimer, the term of this patent is extended or adjusted under 35 U.S.C. 154(b) by 45 days.

(21) Appl. No.: 10/083,243

(22) Filed: Feb. 25, 2002

(65) Prior Publication Data

US 2002/0152705 A1 Oct. 24, 2002

(51) Int. Cl.[7] ..... E04D 1/00

(52) U.S. Cl. ..... 52/519; 52/518; 52/524; 52/539; 52/555; 52/747.11

(58) Field of Search ..... 52/579, 518, 519, 52/524, 539, 555, 747.11, 747.12

(56) References Cited

U.S. PATENT DOCUMENTS 4,930,282 A * 6/1990 Meadows ..... 52/570
5,362,342 A * 11/1994 Murray et al. ..... 52/570
5,941,039 A * 8/1999 Law ..... 52/570

* cited by examiner

*Primary Examiner*—Carl D. Friedman
*Assistant Examiner*—Nahid Amiri
(74) *Attorney, Agent, or Firm*—J. Harold Nissen; Lackenbach Siegel LLP

(57) ABSTRACT

A tile (1) provided with lateral longitudinal fixed joinable lower elements (13) on an underlying surface (8) and upper (14), and at a front end of the tile, an antisliding detent (15) is present. A method and system for covering a roof using a tile (1) having a central curved portion whereby two or more tiers are formed by the tiles joined together by upper elements and lower elements, and adjacent tiers joined together with one tier overlying an adjacent tier and being locked together by the antisliding detent.

18 Claims, 5 Drawing Sheets

DOUBLE CURVED TILE AND METHOD AND SYSTEM FOR COVERING A ROOF THEREWITH

BACKGROUND OF THE INVENTION

1. Field of the Invention

This invention is concerned with a novel curved tile made from a mixture of colored cement. More particularly, the invention is concerned with a tile that can simulate a conventional terra cotta tile after being placed onto a roof of a building. The tile of this invention when joined to a substantially identical tile forms three curved portions.

2. Description of the Prior Art

Curved tile roof coverings are conventionally made from terra cotta and usually has a single curved member with two flat portions at each end. The flat portions are placed onto the outer surface of the roof to be covered. The conventional terra cotta tiles when placed next to each other form two curved portions.

The manufacturing process of the terra cotta tiles or conventional clay tiles will be further distinguished in the further discussion of the invented product.

SUMMARY OF THE INVENTION

The invention is concerned with the manufacture of a unique tile which can be used in connection with a novel method and system to provide a roof covering to simulate a conventional clay or terra cotta roof. Further, the individual tile of the invention can be interconnected with a tile like itself to provide for a three curved roof portions tile covering the area with two tiles.

The curved tile according to the present invention has many innovating advantages when compared with a surface of conventional curved tiles. Costs are almost halved for the installation. For installation, 7.5 units for a square meter instead of 28/30 units for a square meter for conventional curved tiles; the reason for this is that each invented curved tile englobes four conventional curved tiles i.e., two lower tiles of drain and two upper tiles of covering according to the invention, an anti-sliding system of the set up units is provided. A total lack of any roof upkeep is necessary.

First of all, the known performance and difference between a cement covering surface and a brick-covering and moreover particularly for the exacting work of periodical rotation of the covering tiles with the drain ones, working does not exist with the tile according to the invention.

Outright sealing of the roofing surface against the atmospheric agents and against winged animals is provided. Smaller weight for each square meter, for example a weight of 40 (forty) kilograms for the invented tile corresponds to 60 (sixty) kilograms for the conventional tiles.

Total water repellent and total antifreezing characteristics are provided.

The invented curved tile is composed of a sand/cement mixture with coloring iron oxide, to be used instead of the conventional cooked clay, that moreover determines: (a) a very big energetic saving in the manufacturing in comparison with the production of the conventional cooked clay such as the invented cement tile manufacturing requires only an essication working at 30° whereas the conventional clay tile manufacturing needs of a first essication working and subsequently of a cooking phase at 900/1000° for a large number of hours; (b) resistance against the atmospheric agents; (c) performance characteristics with high breaking load and flexibility to permit formation of a covering surface made of tiles of lesser weight in comparison with the conventional tiles; (d) the obtaining of a tile with particular ribs and with a suitable outline so to reduce the number of tiles for each square meter (7.5 units against or versus 28/33 units) in this way providing a large reduction in the weight for each square meter; (e) a big saving on the labor costs necessary for the mounting by virtue of the lesser number of required units.

The above noted advantages provide for the formation of a covering with complete inaccessibility to the space underneath each tile so as to avoid any damage to the covering produced by the penetration of the winged animal.

Moreover, other costs are avoided for the mounting and installation of protection bodies.

The invented tile, with particular relation to its front outline which is obtained by providing during a pressing of the front part re-entering in comparison with the tile curve, after to be actuated the positioning provides a shade visual effect generating a visual perception of a traditional terra cotta covering but avoiding the big problems that come from this conventional covering.

Furthermore, currently the conventional tile must be put in position with grout or by means of fixing hooks. The invented tile is provided with grooves to permit the fixing joint of one tile onto a next adjacent tile, and a detent that avoids the use of another blocking element.

In order that the invention may be more clearly understood and readily carried into effect, the same will not be described in connection with the accompanying drawings.

DETAILED DESCRIPTION OF THE INVENTION

Figure 1:
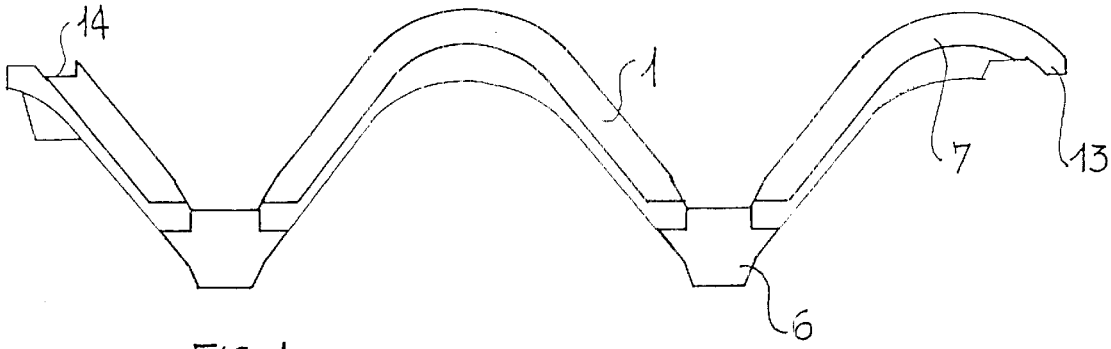
FIG. 1 is a schematic front elevational view showing of a single curved tile according to the invention, having one full curved portion with two semi-curved portions, one at each side of the one full curved position.
Figure 2:
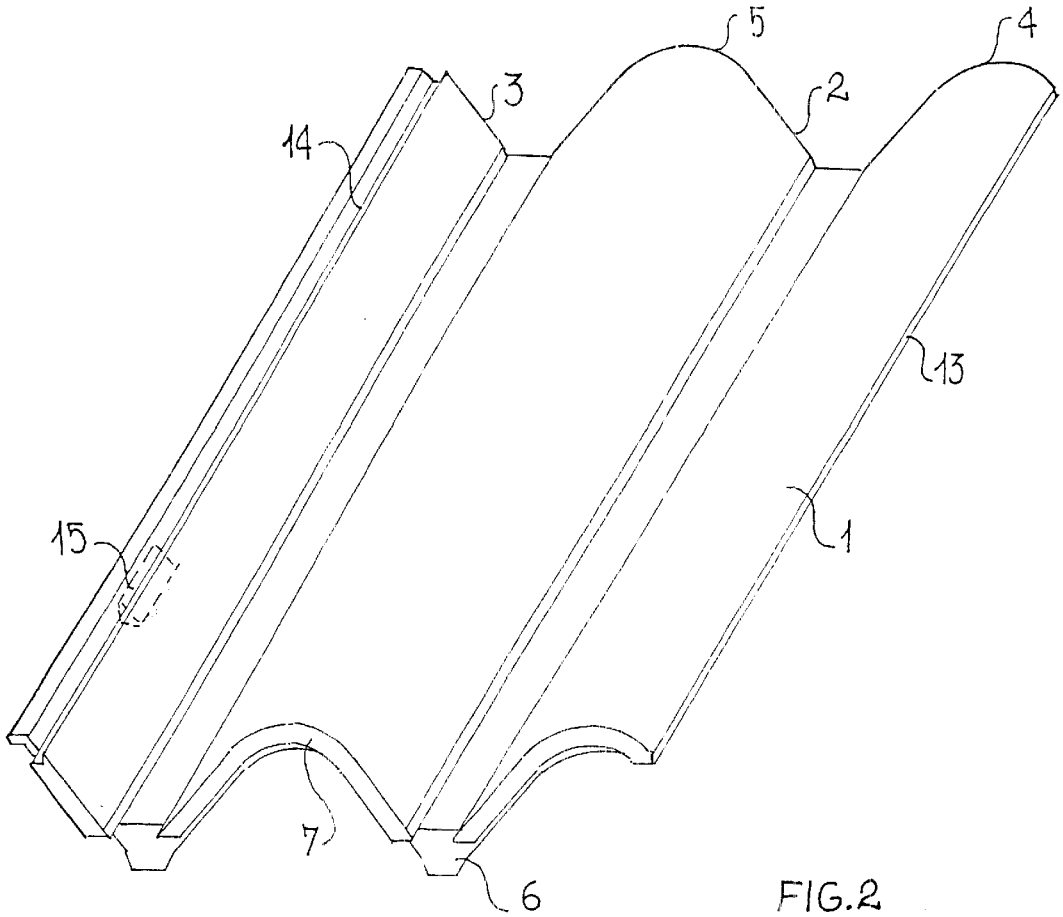
FIG. 2 is a perspective view of the tile of FIG. 1, illustrating in detail, the connectors for connection to a like adjacent tile.

Referring now more particularly to the drawings, tile 1 is formed as a body made by extrusion having a central curved portion 2, see FIG. 2, with two lateral parts 3, and 4 spaced from each other on opposite sides of and attached to the central curved portion 2. Lateral parts 3 and 4 are not of the same shape and have a different configuration from each other and from central part 2, and are connected to form an acute angle with the adjacent sides of the curved portion.

Central curved portion 2 is provided with a rear portion having a back or rear outline 5 and a front portion with a front outline 6 having its upper part between lateral parts 3, 4, provided with a projecting curve 7.

Figure 3:
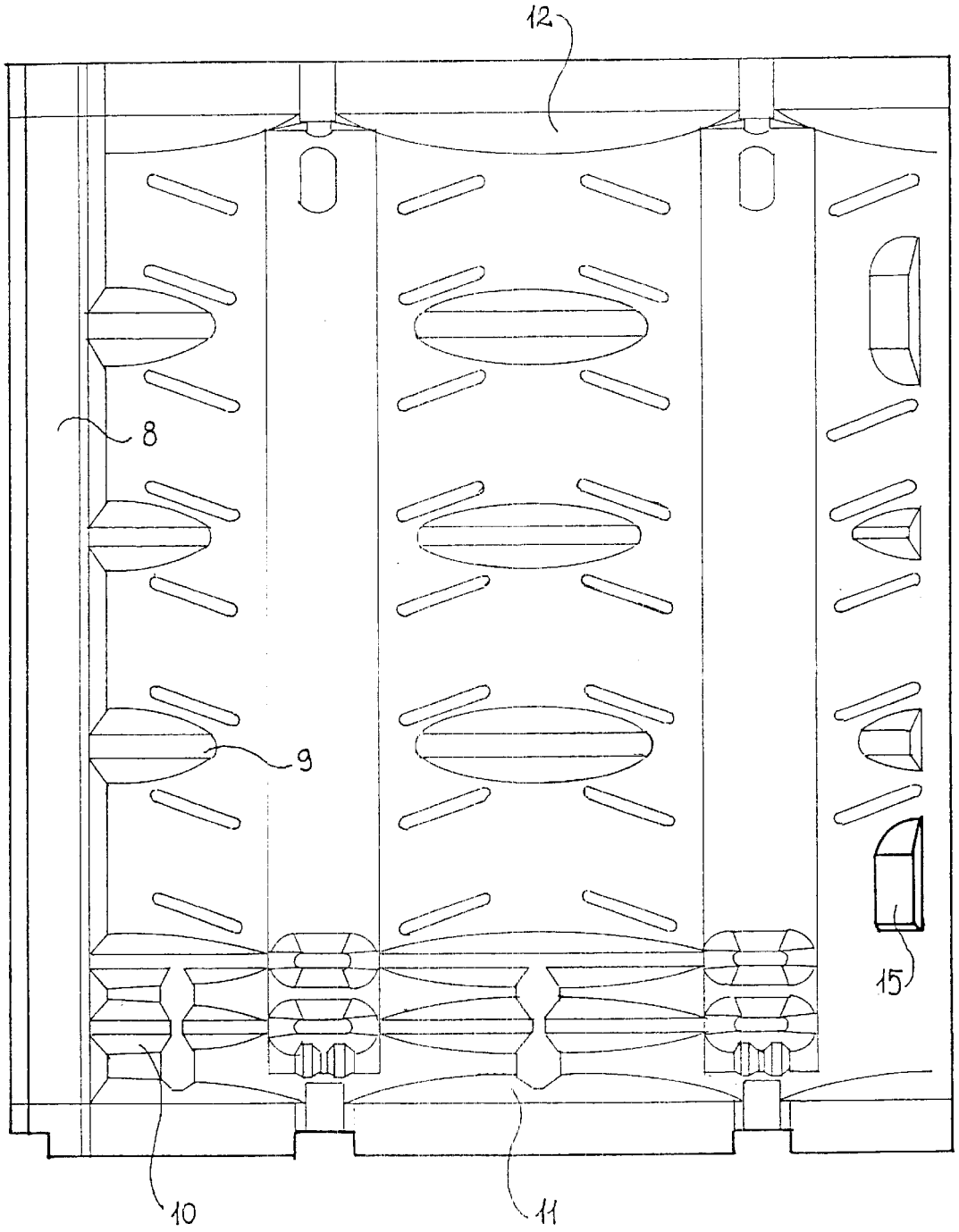
FIG. 3 is a plan view of the undersurface of the tile showing the antisliding detent, stiffening ribs, antidrop ribs, and front and rear support ribs.

As best seen in FIG. 3, tile 1 has a lower or underlying surface 8 formed with stiffening ribs 9 and antidrop ribs 10, front support ribs 11 and rear support ribs 12.

Tile 1 as best seen in FIGS. 2, 5, 6, 7 and 8 is provided with lateral longitudinal fixed joint lower grooves or a connection element 13 on the lower or underlying surface 8 and upper grooves or a connection element 14, and an antisliding detent 15 on the front end of tile 1. When a second tier of tiles overlie a first or next adjacent set of tiles, antisliding detent 15 provides for an appropriate and suitable connection between the two tiers.

Figure 4:
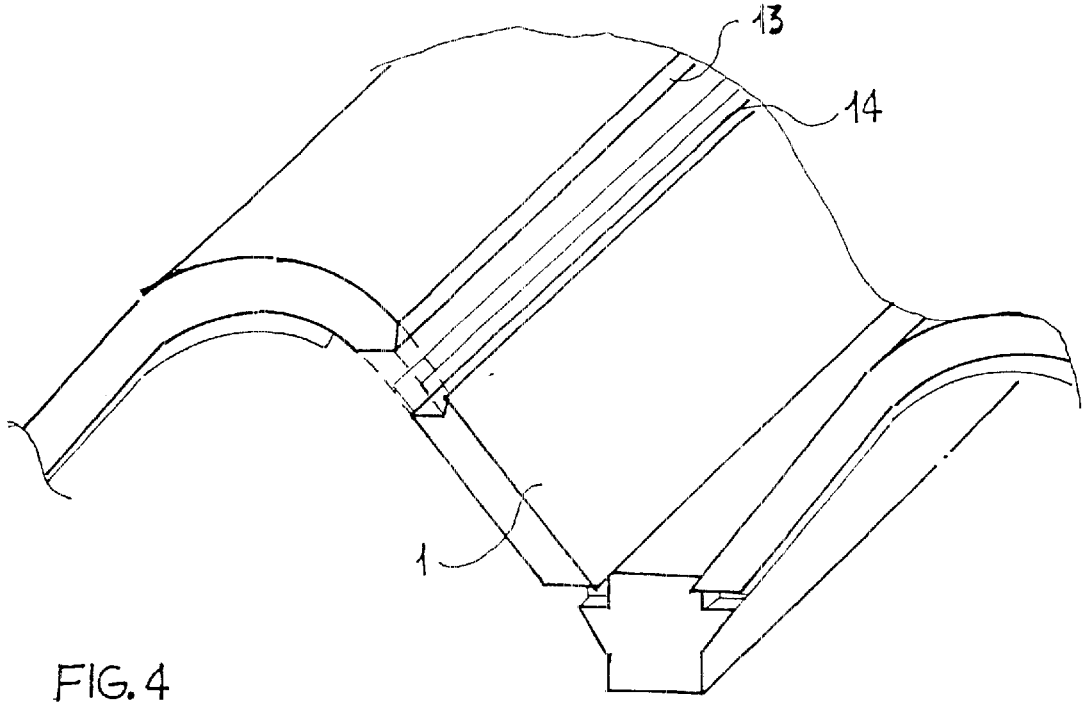
FIG. 4 is a perspective view showing in detail a connection in one direction between the lower grooves of one tile and the upper grooves of a next adjacent tile with the upper and lower grooves of each tile in place with each other connecting the two tiles together.

Referring now more particularly to FIG. 4 which shows a portion of two tiles positioned adjacent to each other in a longitudinal direction as they would be placed onto a roof to provide a covering for the roof. One of the adjacent tiles (unnumbered) is provided with the fixed joint lower connection element 13, and the adjacent tile 1 is provided with the upper groove or element 14 for receiving the lower connection element 13 to connect two adjacent tiles extending in a longitudinal direction, and when connected two adjacent tiles form an upper third curved surface. Lower connection element 13 can also be provided with groove(s) just as the upper connection element 14 can be provided with groove(s) to provide an interconnection between elements 13 and 14.

A first longitudinal tier is laid across a roof to be covered, and for each two adjacently connected tiles, three roof portions are formed.

Figure 5:
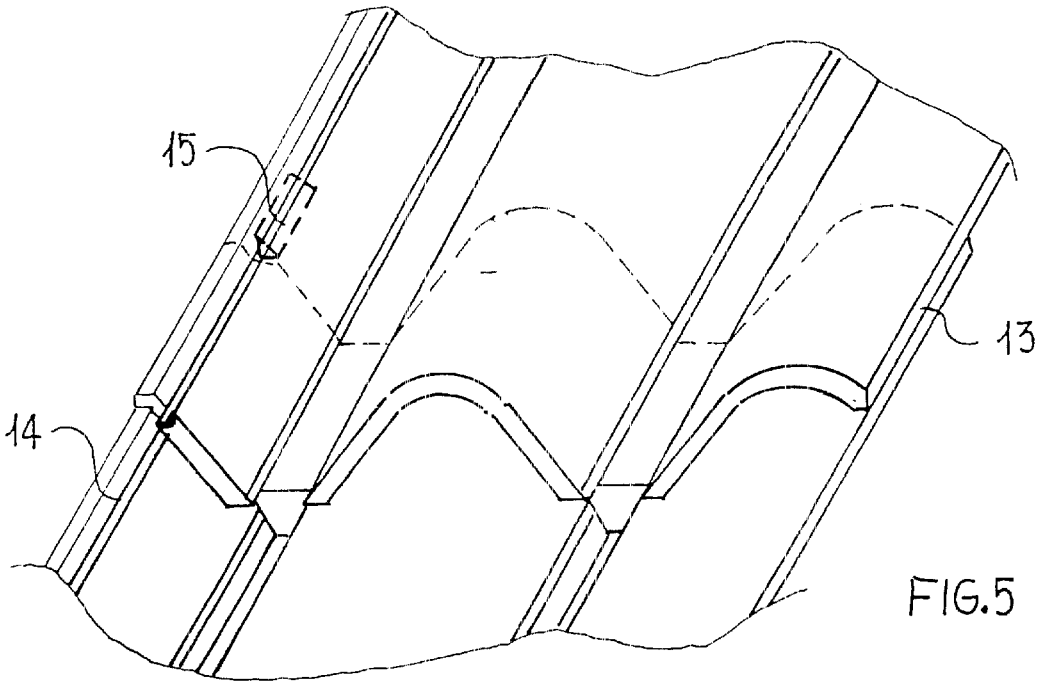
FIG. 5 is a perspective view of two tiles adjacent to each other showing in detail a connection in another direction transverse or orthogonal to the first direction shown in FIG. 4 with one tile overlying its next adjacent tile extending in the direction orthogonal to the tiles in FIG. 4.
Figure 6:
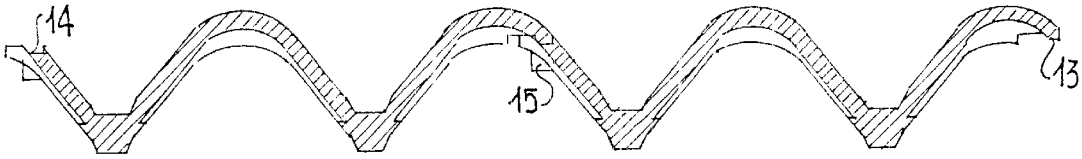
FIG. 6 is a transverse sectional view of two adjacent tiles extending in the first or longitudinal direction with the two adjacent tiles each having its own roof portion and forming a third roof portion when joined.

Referring now more particularly to FIG. 5 a first set of two adjacent tiles are shown interconnected by a connection composed of lower element 13 and upper groove or element 14.

A second set of two adjacent tiles shown interconnected in the same manner as the first set is superimposed on top of the first set, and to provide for the proper alignment and positioning (anti-skidding) anti-sliding upper grooves or element 15 is provided on the lower surface 8 and projecting therefrom so as to provide for the appropriate amount of overlap of the second tier or set of tiles onto the first set of tiles in the first tier.

Figure 7:
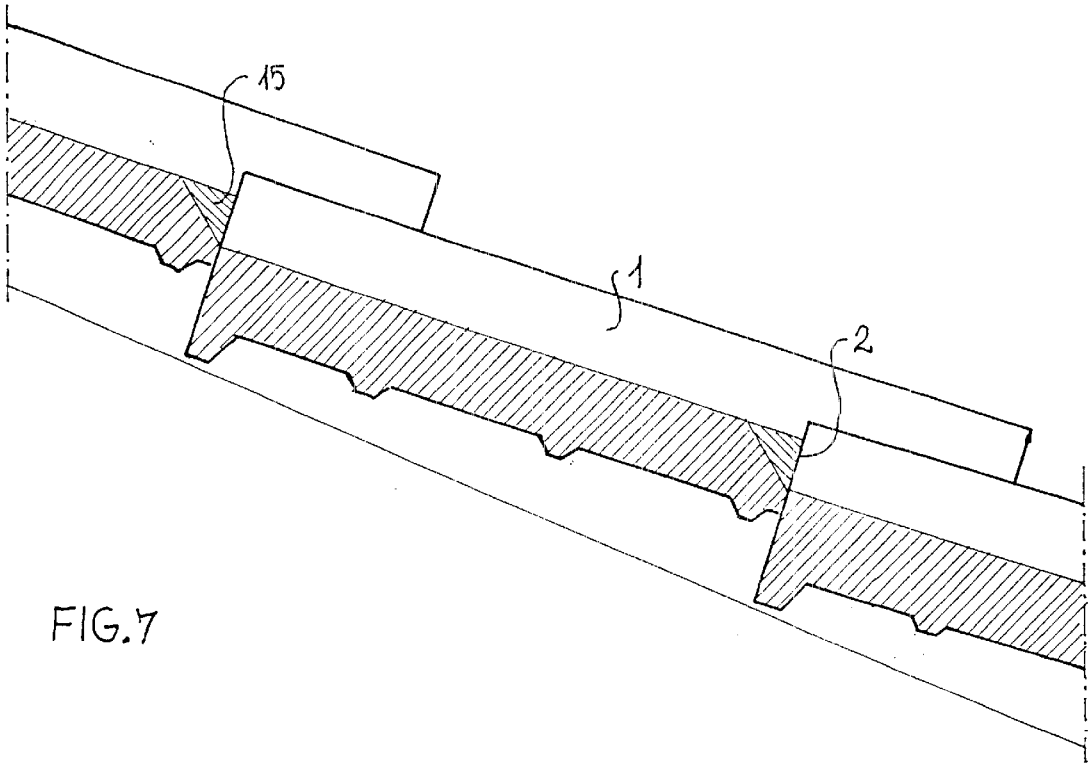
FIG. 7 is a transverse sectional view of three tiers of tiles in overlapping relation as shown in FIG. 5 with adjacent tiles having one end of one tile in on tier overlapping an end of its next adjacent tile in an adjacent tier.
Figure 8:
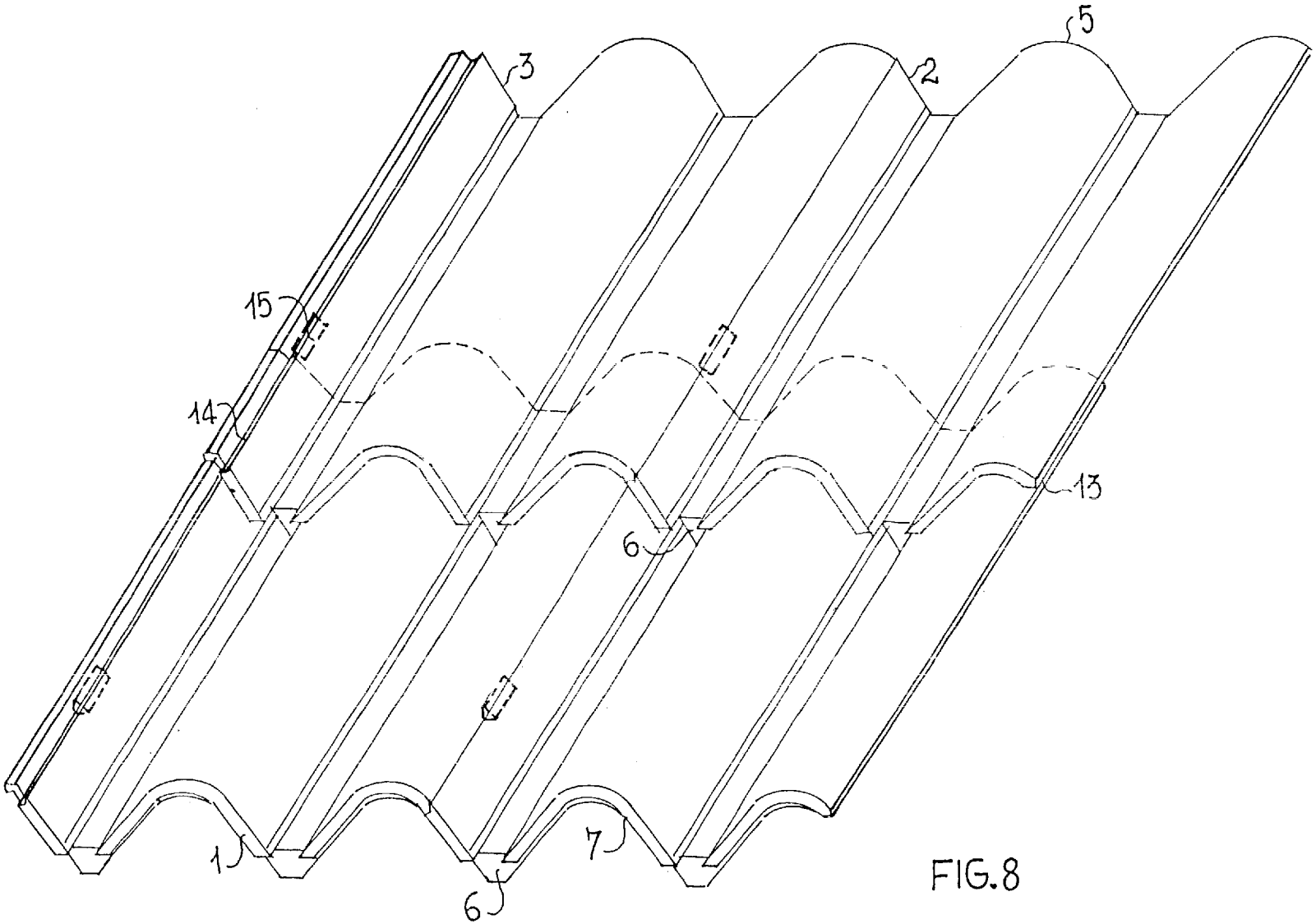
FIG. 8 is a perspective view of a covering part showing a partial view of an installation with two front tiles connected together, forming a first tier in a longitudinal and two rear tiles in a second tier connected together and with the two rear tiles in the second tier connected together overlapping or overlying the front pair of connected tiles in the first tier.

Reference is made to FIG. 7 which shows three sets of two tiles positioned adjacent to each other in an overlapping relationship in an orthogonal or transverse direction to the longitudinal direction as shown in FIG. 4.

As will be evident to those skilled in this art, a novel and unique roof installation or covering is provided in which the covering installation, proceeding from right to left, using the invented tile 1, after placing the connector element 13 of first tile 1 into the grooves 14, the over surface of the upper groove 14 are inserted into the longitudinal grooves 13 of the underlying surface of the second or adjacent tile 1. Clearly, other suitable connection between elements 13 and 14 may be provided.

Ending the disposition of the first tier or set of tiles, one proceeds in the same way for preparing a second tier of tiles, and the descent of the tile 1 of the second tier by means of detent 15 that comes to stop itself against the back outline 5 of the first Ending the disposition of the first tier or set of tiles, one proceeds in the same way for preparing a second tier of tiles, and the descent of the tile 1 of the second tier by means of detent 15 that comes to stop itself against the back outline 5 of the first tier of tiles that precedes in the downstream tier of tiles to bringing the front part of the second tier on 9 centimeters superimposition onto the back part of the files of the first tier of tiles or the downstream set of tiles previously placed.

So in procedure or prosecution until the complete covering of the pitch and always using 7.5 unit per square meter.

The invented tile and the mounting system of the same so obtained, produces a cement covering to be visually equal to one with terra cotta tiles are as illustrated in the accompanying drawings.

It will be evident to those skilled in the art that various changes and modifications may be made without departing from the scope of the invention.

What is claimed is:

1. A double curved tile including an anti-sliding fixing formed body (1), made by extrusion, said body having a central curved portion (2) provided with two lateral parts (3 and 4) each of a different shape with a back outline (5) and a front outline (6) having its upper part provided with a projecting curve (7) and having a lower or underlying surface (8) formed by means of stiffening ribs (9), antidrop ribs (10) and front (11) support ribs and rear (12); and lateral longitudinal fixed joint lower grooves (13) on the underlying surface (8) and upper grooves (14) while always on the underlying surface, and having on the front end of the body of the tile an antisliding detent (15).

2. The tile according to claim 1, when used for a covering installation, proceeding from right to left, comprising subsequent to placement of the lower grooves (13) a first tile (1) into the grooves (14) of its over surface, the longitudinal grooves 13 of a next tile are inserted into the grooves (14) of a second tile (1); and ending the disposition of the first tile and it is proceeding in the same way for actuating the second tile stopping descent of the tile (1) of the second tile by means of its associated detent (15) that cause the second tile to stop itself against the back outline (5) of the tile that precedes it in the downstream tile to bring its front part in super-imposition onto the back part of the tile that downstream precedes, so in prosecution until a complete covering of the pitch.

3. A method for coating a roof with a curved tile manufactured from a mixture of colored cement comprising the steps of:

forming a tile having a curved portion with a first connection portion on one end and a second connection portion on an opposite end, said first and second connection portions having complementary connectors for connecting two tiles positioned adjacent to each other, laying a first tier composed of said curved tiles in a first or longitudinal direction across the roof to be covered and connecting said tiles together in a horizontal direction, laying a second tier composed of said curved tiles in a second longitudinal direction across the roof to be covered, with a front edge of said second tier of tiles having an underface provided with anti-drop ribs projecting from said underface and an overlapping a rear portion of said first tier of tiles to form two tiers of tiles coupled together longitudinally and in a direction orthogonal or transverse to said longitudinal direction.

4. The method according to claim 3, including providing an antisliding element proximate to the front end of said second tier of tiles extending downwardly from an undersurface of said second tier of tiles.

5. The method according to claim 3, wherein the first connection portion of one of said tiles is different from the second connection portion of the other of said tiles joined to the second connection portion of another of said tiles adjacent to said one tile and said two adjacent tiles connected together form another curved portion.

6. The method according to claim 3, including providing a plurality of partially overlapping tiers of curved tiles, each of said tiers having at an undersurface thereof proximate to said front portion an antisliding element projecting downwardly to prevent the partially overlapping tiers from becoming disengaged.

7. The method according to claim 3, wherein said first portion is a lateral part with an upper projecting curve having a receiving portion, and said second portion is a lateral part having a projecting member adapted to be received within said upper projecting portion for locking two adjacent tiles together.

8. A tile for use in connection with coating a roof with tiles having a curved portion manufactured of colored cement, comprising a central curved portion including front and rear support ribs; a first lateral part extending from one side of said central curved portion, and a second lateral part extending from an opposite side of said central curved portion;

an upper connecting element connected with an end of said first lateral part, and a lower connecting element connected with an end of said second lateral part and adapted to be connected with said upper connecting element to form therewith a connection to provide joinder of two of said tiles; and each under face of the tile in each tier is provided with stiffening ribs and antidrop ribs.

9. The tile as claimed in claim 8, wherein said tile has an upper face and an under face, and including an anti-sliding member projecting downwardly from said under face.

10. The tile as claimed in claim 8, including stiffening ribs projecting from said under face.

11. The tile as claimed in claim 9 including a front supporting rib projecting from said under face to overlay another tile.

12. The tile as claimed in claim 8 including a rear supporting rib projecting from said under face to overlay another tile.

13. The tile as claimed in claim 8, wherein said upper connecting element and said lower connecting element have grooved portions and said grooved portions interconnect said first and second lateral parts.

14. A system for coating a roof and using a tile as claimed in claim 8, comprising a plurality of tiers of tiles including:

a first tier of said tiles with adjacent tiles being connected together by said upper element and said lower element;

a second and subsequent tiers of tiles each including an anti-sliding member projecting downwardly from said under face; and the under face of each of said second tier of tiles overlying the upper face of said first tier of tiles and an antiskidding member projecting from the under face of said tiles to lock said first and second tiers together to prevent movement longitudinally and transversally thereof.

15. The system as claimed in claim 14, wherein each tier is comprised of tiles having front support ribs and rear supports ribs.

16. The system as claimed in claim 14 wherein each of said first lateral portions when connected to said adjacent lateral portion together form a third curved roof simulating the curved roof of each of said tiles.

17. The system as claimed in claim 8, wherein the first lateral part has a first configuration.

18. The system as claimed in claim 8, wherein the second lateral part has a second configuration.

* * * * *